US011150678B2

(12) United States Patent
Nicollini et al.

(10) Patent No.: US 11,150,678 B2
(45) Date of Patent: Oct. 19, 2021

(54) FREQUENCY COMPENSATION CIRCUIT AND CORRESPONDING DEVICE

(71) Applicant: STMicroelectronics S.r.l., Agrate Brianza (IT)

(72) Inventors: Germano Nicollini, Piacenza (IT); Stefano Polesel, Treviso (IT)

(73) Assignee: STMicroelectronics S.r.l., Agrate Brianza (MB) (IT)

( * ) Notice: Subject to any disclaimer, the term of this patent is extended or adjusted under 35 U.S.C. 154(b) by 0 days.

(21) Appl. No.: 16/869,084

(22) Filed: May 7, 2020

(65) Prior Publication Data

US 2020/0356127 A1 Nov. 12, 2020

(30) Foreign Application Priority Data

May 10, 2019 (IT) ..... 102019000006715

(51) Int. Cl.
*G05F 3/26* (2006.01)
*G05F 1/59* (2006.01)

(52) U.S. Cl.
CPC ..... *G05F 1/59* (2013.01); *G05F 3/262* (2013.01); *G05F 3/26* (2013.01)

(58) Field of Classification Search
CPC ..... G05F 1/59; G05F 1/56; G05F 3/26; G05F 3/262
See application file for complete search history.

(56) References Cited

U.S. PATENT DOCUMENTS 5,408,174 A 4/1995 Leonowich
5,945,873 A * 8/1999 Antone ..... G05F 3/265 327/541
6,348,835 B1 * 2/2002 Sato ..... G05F 3/262 327/543

(Continued)

FOREIGN PATENT DOCUMENTS

WO WO-2006083490 A2 * 8/2006 ..... G05F 1/575

OTHER PUBLICATIONS

Apirak Suadet; Varakorn Kasemsuwan; "A compact class-AB bulk-driven quasi-floating gate current mirror for low voltage applications"; Oct. 24, 2013; IEEE; pp. 298-302 (Year: 2013).*

(Continued)

*Primary Examiner* — Thienvu V Tran
*Assistant Examiner* — Shahzeb K Ahmad
(74) *Attorney, Agent, or Firm* — Crowe & Dunlevy

(57) ABSTRACT

A current mirror includes first and second transistors having current paths coupled to an input current line. The current paths for the first and second transistors are referenced to ground via respective first and second resistors having resistance values twice a first resistance value. The first transistor is diode connected. A third transistor has a current path coupled to an output current line and referenced to ground via a third resistor having a second resistance value equal to the first resistance value divided by a mirror factor. Control terminals of the first and third transistors are coupled together, and further coupled to a control terminal of the second transistor through a coupling resistor. A first capacitor is coupled between ground and the control terminal of the second transistor unit. A second capacitor is coupled between ground and the current path through the third transistor.

13 Claims, 3 Drawing Sheets

(56) References Cited

U.S. PATENT DOCUMENTS

| | | | | |
|---|---|---|---|---|
| 9,312,747 | B1 * | 4/2016 | Svorc | G05F 3/262 |
| 2003/0178978 | A1 * | 9/2003 | Biagi | G05F 1/575<br>323/282 |
| 2012/0049921 | A1 * | 3/2012 | Chang | G05F 3/262<br>327/307 |
| 2017/0308108 | A1 * | 10/2017 | Pigott | G05F 1/571 |

OTHER PUBLICATIONS

Wiki Analog Devices; "Chapter 11: The Current Mirror"; Sep. 17, 2018; Wiki Analog Devices; Retrieved from website: https://wiki.analog.com/university/courses/electronics/text/chapter-11?rev=1536947988 (Year: 2018).*

Wiki Analog Devices: "Chapter 11: The Current Mirror", Sep. 17, 2018, XP002796821.

Balmford R A H et al: "New High-Compliance CMOS Current Mirror With Low Harmonic Distortion for High-Frequency Circuits", Electronics Letters, IEE Stevenage, GB, vol. 29, No. 20, Sep. 30, 1993, XP000400412.

ESR, Stability, and the LDO Regulator, Texas Instruments SLVA115, 2002.

Leung, "A capacitor-free CMOS low-dropout regulator with damping-factor-control frequency compensation," IEEE JSSC vol. 38, No. 10, Oct. 2003.

IT Search Report and Written Opinion for IT Appl. No. 102019000006715 dated Jan. 13, 2020 (9 pages).

* cited by examiner

FREQUENCY COMPENSATION CIRCUIT AND CORRESPONDING DEVICE

PRIORITY CLAIM

This application claims the priority benefit of Italian Application for Patent No. 102019000006715, filed on May 10, 2019, the content of which is hereby incorporated by reference in its entirety to the maximum extent allowable by law.

TECHNICAL FIELD

The description relates to frequency compensation circuits.

One or more embodiments may be applied, for instance, to Low-Drop Out (LDO) regulator devices.

BACKGROUND

In the electronic field, the insertion of one or more pole-zero doublets in a circuit is often used to facilitate a frequency compensation task.

An exemplary case of such a compensation task is LDO regulator frequency compensation, for instance when an LDO is used to supply large digital blocks. In that case, a fast reaction to load changes (to recover within, for example, 10% of the final value) is a desirable feature.

If the LDO is equipped with an external capacitor, a pole-zero doublet can be created by either adding an external resistor in series to the capacitor or by exploiting the equivalent series resistance (ESR) of the capacitor ESR, if possible (see, for instance, J. Falin: "ESR, stability and the LDO regulator", Texas Instruments Application Report SLVA115, May 2002).

This may represent an expensive solution, and cap-less LDOs are increasingly used at the cost of complex and power expensive internal solutions (see, for instance, K. N. Leung et al: "A capacitor-free CMOS low-dropout regulator with damping-factor-control frequency compensation" IEEE Journal of Solid-state Circuits, Vol. 38, No. 10, October 2003, pp. 1691-1702).

Despite the fairly extensive activity in that area, further improved solutions are desirable.

SUMMARY

One or more embodiments may offer one or more of the following advantages:

flexibility due to the possibility of selecting the zero and pole positions according to compensation specifications: one simple zero only, first a zero and then a zero-pole doublet, first a zero and then a pole-zero doublet, first a pole-zero doublet and then a zero, for instance;

no extra power needed, with only a slight increase in semiconductor area.

BRIEF DESCRIPTION OF THE DRAWINGS

One or more embodiments will now be described, by way of example only, with reference to the annexed figures, wherein.

DETAILED DESCRIPTION

In the ensuing description, one or more specific details are illustrated, aimed at providing an in-depth understanding of examples of embodiments of this description. The embodiments may be obtained without one or more of the specific details, or with other methods, components, materials, etc. In other cases, known structures, materials, or operations are not illustrated or described in detail so that certain aspects of embodiments will not be obscured.

Reference to "an embodiment" or "one embodiment" in the framework of the present description is intended to indicate that a particular configuration, structure, or characteristic described in relation to the embodiment is comprised in at least one embodiment. Hence, phrases such as "in an embodiment" or "in one embodiment" that may be present in one or more points of the present description do not necessarily refer to one and the same embodiment. Moreover, particular conformations, structures, or characteristics may be combined in any adequate way in one or more embodiments.

The references used herein are provided merely for convenience and hence do not define the extent of protection or the scope of the embodiments.

Figure 1:
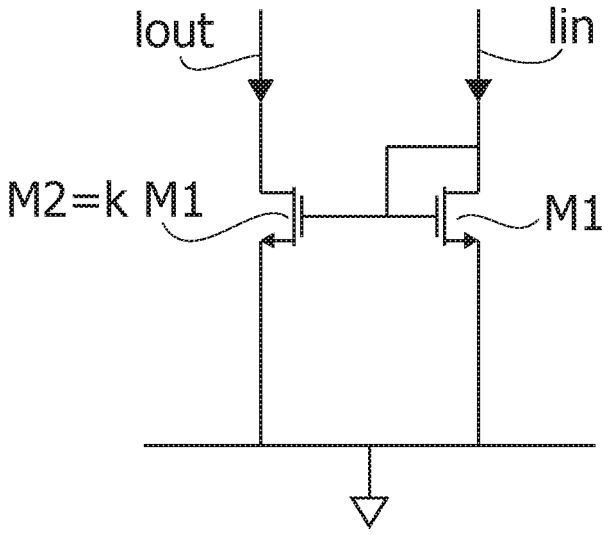
FIGS. 1 and 2 are circuit diagrams of current mirror circuits.

The diagram of FIG. 1 is exemplary of a current mirror building block as used in a wide variety of analog circuits.

As exemplified in FIG. 1, such a current mirror circuit comprises a first transistor M1 (field-effect transistors such as MOSFETs will be exemplified throughout this description for simplicity) having the current path therethrough (source-drain in the case of field-effect transistor such as a MOSFET) arranged in a current line supplied with an (input) current Iin generated in any manner known to those of skill in the art.

As exemplified in FIG. 1, the control terminal (gate, in the case of field-effect transistor such as a MOSFET) of the transistor M1 is shorted to the current path (at the drain) in a diode-like arrangement with the current path referenced (at the source) to ground GND.

The current mirror exemplified in FIG. 1 also comprises a second transistor M2 having its control terminal (gate, in the case of field-effect transistor such as a MOSFET) coupled to the control terminal of M1 and the current path therethrough arranged in a current line through which an (output) current Iout flows, which "mirrors" the input current Iin via a mirror factor k.

The arrangement of FIG. 1 is largely conventional in the art (as exemplified and also in the possible variants comprising transistors of types and polarities different from those exemplified herein), which makes it unnecessary to provide a more detailed description herein.

A solution facilitating the provision of a pole-zero doublet on such a current mirror circuit without adding extra current consumption would be desirable.

It is noted that a basic current mirror as exemplified in FIG. 1 has following Iin-Iout transfer function:

$$\frac{I_{out}}{I_{in}} = \frac{g_{m2}}{g_{m1}} * \frac{1}{1 + s\frac{C_{gs2} + C_{gs1}}{g_{m1}}}$$

where $g_{m1}$, $g_{m2}$ and $C_{gs1}$, $C_{gs2}$ denote the transconductances and the gate-source (parasitic) capacitances of M1 and M2, respectively.

Assuming that M2=kM1, for instance with the width W2 of M2*k* times the width W1 of M1 (that is W2=kW1) and the length L2 of M2 equal to the length L1 of M1 (that is L2=L1) with K>1 and an integer (which is a thoroughly judicious assumption)→$g_{m2}=kg_{m1}$ and $C_{gs2}=kC_{gs1}$ so that:

$$\frac{I_{out}}{I_{in}} = k\frac{1}{1+s\frac{C_{gs1}(1+k)}{g_{m1}}}$$

Such a transfer function has only a pole (p) at:

$$-\frac{g_{m1}}{(1+k)C_{gs1}};$$

this is at a high frequency and cannot be used for compensation as this may adversely affect stability.

Another solution oftentimes used to implement current mirrors involves adding resistive degeneration, as exemplified in FIG. 2, where parts or elements like parts or elements already discussed in connection with FIG. 1 are indicated with like reference symbols.

Essentially, the degenerated current mirror involves two resistors R1 and R2 (with the resistive value of R2 equal to 1/k the resistive value of R1) arranged in the current lines for Iin and Iout between the transistors M1 and M2, respectively, and ground GND.

Figure 2:
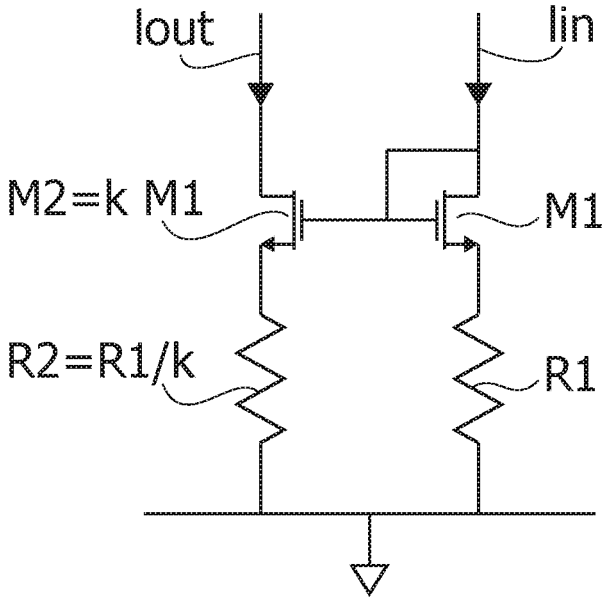

It can be shown that, in a current mirror as exemplified in FIG. 2, the Iin-Iout transfer function becomes a bit more complicated, with a pole ($p_1$) at $$-\frac{g_{m2}}{C_{gs2}}$$

and a zero-pole doublet ($p_2$) around:

$$\cong z = -\frac{g_{m1}}{C_{gs1}}$$

where zero and pole tend to cancel each other, thus leaving again a single pole behavior with related constrains.

A flexible solution making it possible to "play" with the positions of the pole and zero in the doublet, i.e. pole before zero and vice-versa is desirable.

A solution facilitating an (accurate) control of the pole-zero distance independently of process, supply voltage, and temperature variations is likewise desirable.

Another desirable feature is represented by the possibility of adding only a zero (instead of a pole, as discussed previously), which would facilitate stability.

Figure 3:
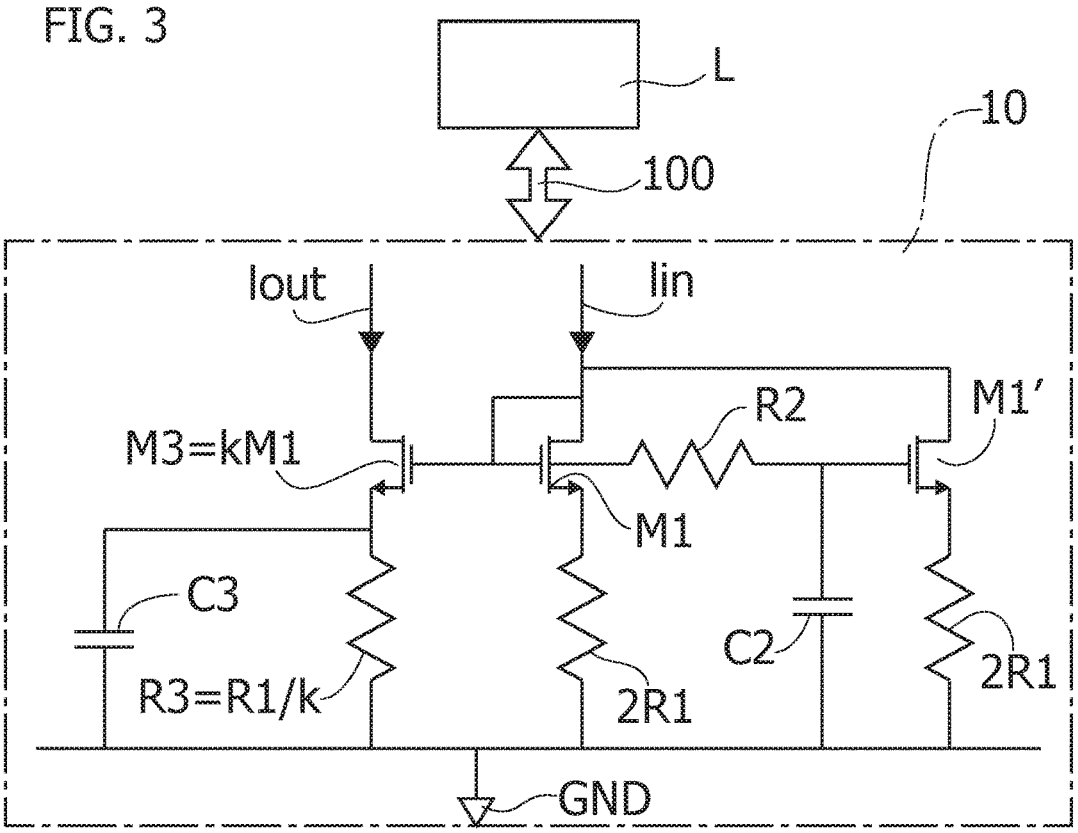
FIGS. 3 to 5 are circuit diagrams of improved current mirror circuits.

One or more embodiments may be based on the current mirror circuit exemplified in FIG. 3, which may be included in a device 10, such as a LDO regulator device supplying a load L coupled to an output port (for instance, 100) of the device 10. The output port 100 may be coupled to an output current line Iout as discussed in the following with output port configured—in a manner known to those of skill in the art—to provide a regulated (voltage, for instance) signal at the output port 100 for use by the load L.

In the current mirror exemplified in FIG. 3, the diode-connected transistor of the current mirror (that is, M1 as exemplified in FIGS. 1 and 2) is so-to-say "split-into-two" to comprise two symmetrical (that is, essentially identical) transistor units M1, M1' with half width and same length (0.5×M1) in comparison with M1 as exemplified in FIGS. 1 and 2.

Of these two (half) transistor units, the (first) unit M1 is arranged essentially in the same manner of the transistor M1 of FIGS. 1 and 2, namely with the current path therethrough (source-drain in the case of field-effect transistor such as a MOSFET) in a current line supplied with (a portion) of the input current Iin, again generated in any manner known to those of skill in the art.

As exemplified in FIG. 3, the (second) transistor unit M1' has the current path therethrough coupled (at the drain) to the current line through the first unit M1 at the side of the unit M1' (the drain) opposite to the degeneration resistor.

As exemplified in FIG. 3, the degeneration resistor (R1 in FIG. 2, by way of direct reference) can be similarly split into two equal resistors 2R1 with same width and double length, thus having a resistive value twice the resistive value of R1.

For simplicity, throughout this description a same designation is used to indicate resistors in the circuit diagram and the resistive value thereof.

In the current mirror circuit exemplified in FIG. 3, the control terminal (gate) of the first (half) transistor unit M1 is coupled to the control terminal (gate) of the second (half) transistor unit M1' via a resistor R2 included in a RC low-pass network which also includes, in addition to the resistor R2, a capacitor C2 coupled between the control terminal (gate) of M1' and ground GND.

The current mirror circuit exemplified in FIG. 3 also comprises a transistor M3=k*M1 (that is, with M3 having for instance a width k times the width of M1 the same length of M1) having its control terminal (gate, in the case of field-effect transistor such as a MOSFET) coupled to the control terminal of M1 and the current path therethrough arranged in a current line through which an (output) current Iout flows, which "mirrors" the input current Iin via the mirror factor k.

In the current mirror exemplified in FIG. 3, the current path through M3 is referred (at the source) to ground GND via the parallel arrangement of a resistor R3 having a resistive value equal to R1/k and a capacitor C3.

By applying standard network analysis and under the judicious assumption that:

C2 and C3 lend themselves to be implemented with capacitance values $C_2$ and $C_3$ largely in excess of any parasitic capacitance $C_{gs}$ of the transistors in the mirror circuit; and the current mirror ratio k is an integer number (which is by large a common case in circuit design);

one may show that the Iin-Iout transfer function the current mirror exemplified in FIG. 3 can be expressed (in the complex domain s) as:

$$\frac{i_{out}}{i_{in}} = \frac{R_1}{R_3}\frac{(1+sC_2R_2)(1+sC_3R_3)}{\left[1+s\frac{C_2(R_2+2R_1)}{2}\right]\left(1+s\frac{C_3}{g_{m3}}\right)}$$

where:

$R_1$, $R_2$ and $R_3$ are the resistive values introduced in the foregoing, $C_2$ and $C_3$ indicate the capacitance values of the capacitors C2 and C3, $g_{m3}$ denotes the transconductance of the transistor M3.

The Iin-Iout transfer function the current mirror exemplified in FIG. 3 thus comprises:

$$-\text{two zeroes } z_1 = -\frac{1}{R_3C_3},\ z_2 = -\frac{1}{R_2C_2},$$

$$-\text{a first pole } p_1 = -\frac{2}{(R_2+2R_1)C_2},\ \text{and}$$

$$-\text{another pole } p_{HF} = -\frac{g_{m3}}{c_3},$$

which is a high-frequency pole which may be regarded as of no interest for compensation purposes.

Selecting the resistance and capacitance values (sizing) of the resistors $R_i$ and the capacitors $C_i$ presented in the exemplary diagram of FIG. 3 facilitates implementing several different scenarios, such as (by way of non-limiting example):

*a*) $p_1<z_2<z_1$ or $p_1<z_1<z_2 \rightarrow$pole-zero doublet+zero

*b*) $p_1=z_2<z_1$ or $z_1<p_1=z_2 \rightarrow$*no* doublet+simple zero

*c*) $p_1=z_1<z_2$ or $z_2<p_1=z_1 \rightarrow$*no* doublet+simple zero

*d*) $z_1<z_2<_{p1}$ or $z_2<z_1<p_1 \rightarrow$zero+zero-pole doublet

The basic layout of FIG. 3 lends itself to possible variants and/or to somehow simplified implementations.

For instance, embodiments as discussed previously in connection with FIG. 3 refer to two transistor units M1 and M1' each of which can be (notionally) regarded as exemplary of a "half" transistor resulting from splitting into two a transistor such as M1 in FIG. 2, for instance with each of M1 and M1' in FIG. 3 having half the width and the same length of M1 in FIG. 2 with the associated degeneration resistors 2R1 having a resistive value twice the value R1 of the degeneration resistor associated with M1 in FIG. 2.

Embodiments as discussed previously in connection with FIG. 3 may be regarded as advantageous implementations of the more general concept of "splitting" the transistor M1 in FIG. 2 into two transistor units M1 and M1' corresponding to αM1 and (1-α)M1, respectively, with a selected in the range 0 to 1. This may be obtained, for instance, by causing M1 and M1' in FIG. 3 to have the same length of M1 in FIG. 2 and widths equal to α times and (1-α) times the width of M1 in FIG. 2, with the sum of α and (1-α) equal to one.

The associated degeneration resistors (indicated as 2R1 in FIG. 3) may correspondingly be implemented with resistive values equal to:

R1/α for the degeneration resistor associated with the transistor unit M1 in FIG. 3, and R1/(1-α) for the degeneration resistor associated with transistor unit M1' in FIG. 3, respectively.

In that, more general case, the Iin-Iout transfer function the current mirror exemplified in FIG. 3 can be expressed (in the complex domain s) as:

$$\frac{i_{out}}{i_{in}} = \frac{R_1}{R_3}\frac{(1+sC_2R_2)(1+sC_3R_3)}{[1+sC_2(R_1+\alpha R_2)]\left(1+s\frac{C_3}{g_{m3}}\right)}$$

It will be easily appreciated that the formula above corresponds to the formula discussed previously by setting α=0.5, with essentially the same remarks applying to the zero and pole locations.

To sum up, implementing the transistor units M1 and M1' as substantially identical (half) transistors, having associated substantially identical degeneration resistors (that is with α equal or in the vicinity of 0.5), while advantageous, is not a mandatory feature of the embodiments.

Figure 4:
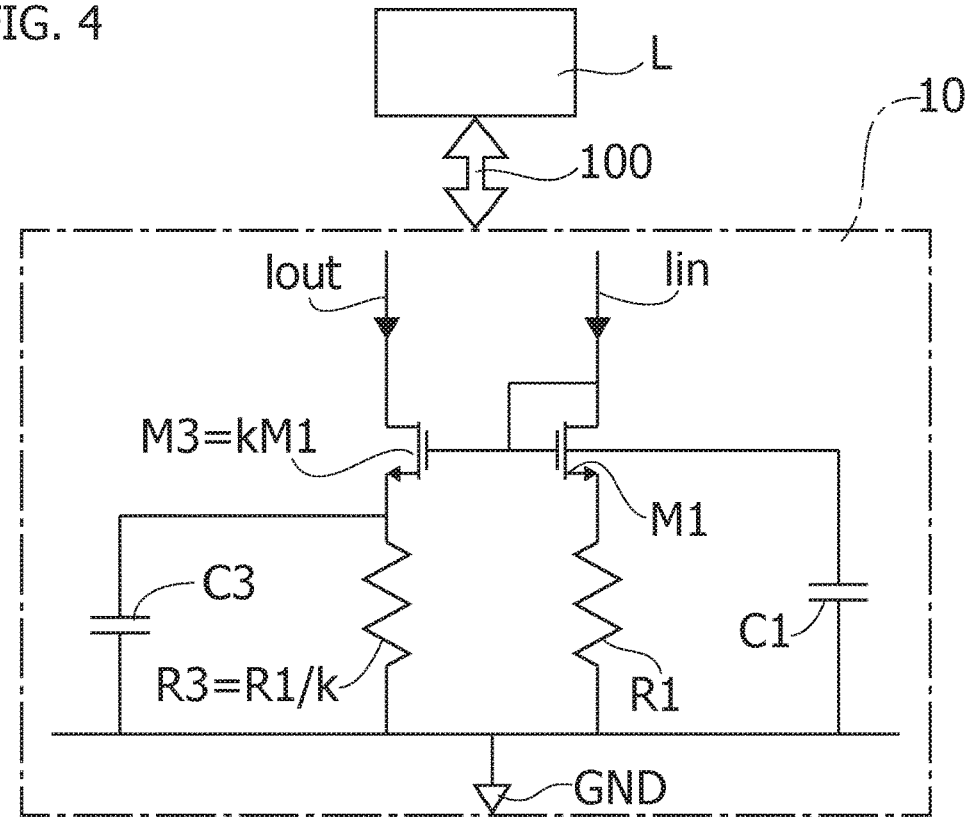

A first simplified embodiment, as illustrated in FIG. 4, can be regarded as obtained from FIG. 3 by simply shorting R2, i.e. R2=0 and dispensing with M1' (and the associated degeneration resistor) so that the transistor M1, having its control terminal (gate) shorted to the current path (at the drain) in a diode-like arrangement has again the current path therethrough referred (at the source) to ground GND via a resistor R1 with a capacitor C1 having a capacitance value $C_1$ coupled between its control terminal (gate) and ground GND.

In an arrangement as exemplified in FIG. 4 (where M1 can be regarded as essentially corresponding to M1 in FIG. 2), the Iin-Iout transfer function becomes:

$$\frac{i_{out}}{i_{in}} = \frac{R_1}{R_3}\frac{1+sC_3R_3}{[1+sC_1R_1]\left(1+s\frac{C_3}{g_{m3}}\right)}$$

There is one zero $$z_1 = -\frac{1}{R_3C_3},\ \text{a pole } p_1 = -\frac{1}{R_1C_1},$$

and another pole which is at high frequency and is of no interest for compensation.

Figure 5:
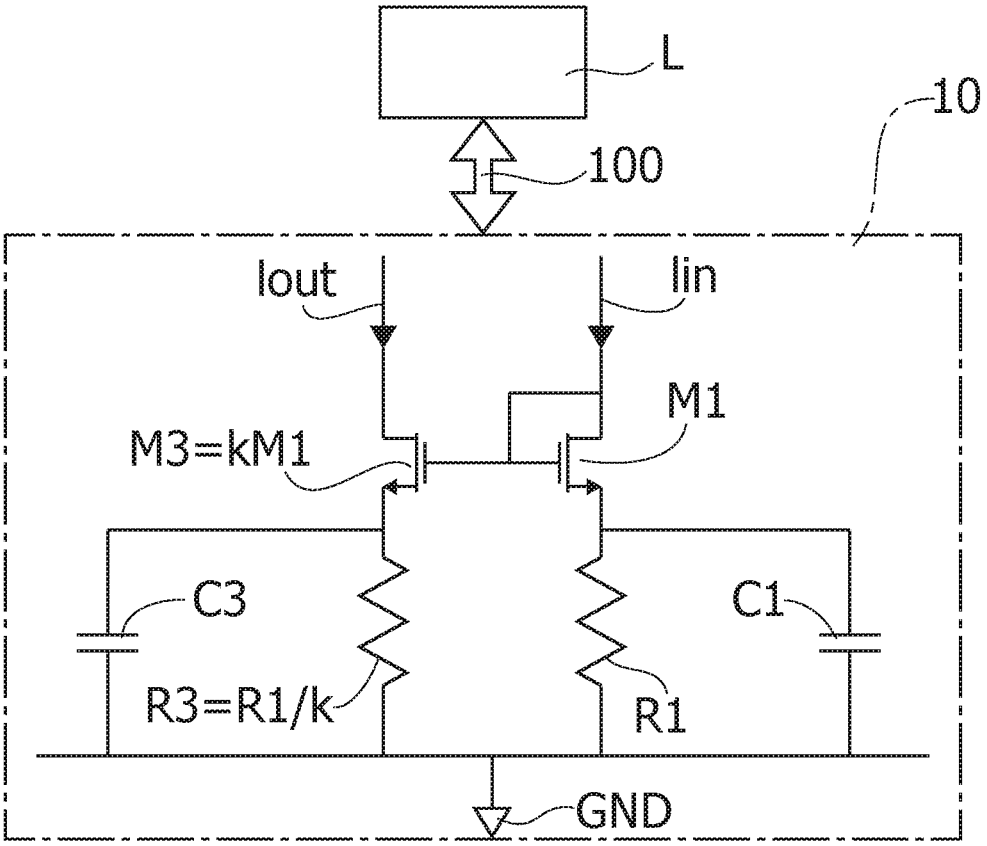

According to the sizing of the $R_i$ and $C_i$ two scenarios are possible:

a) $p_1<z_1 \rightarrow$pole-zero doublet b) $z_1<p_1 \rightarrow$zero-pole doublet Another possible simplified embodiment as exemplified in FIG. 5 can be regarded as having been obtained from the embodiment exemplified in FIG. 4 by simply "moving" C1 from the control terminal (gate) to the current path (source) of M1.

In an embodiment as exemplified in FIG. 5 (where M1 can again be regarded as essentially corresponding to M1 in FIG. 2), the Iin-Iout transfer function becomes:

$$\frac{i_{out}}{i_{in}} = \frac{R_1}{R_3}\frac{(1+sC_3R_3)\left(1+s\frac{C_1}{g_{m1}}\right)}{[1+sC_1R_1]\left(1+s\frac{C_3}{g_{m3}}\right)}$$

There is one zero $$z_1 = -\frac{1}{R_3C_3},\ \text{a pole } p_1 = -\frac{1}{R_1C_1},$$

and a couple of pole and zero which are at high frequency and are of no interest for compensation.

According to the sizing of the $R_i$ and $C_i$ two scenarios are possible:

a) $p_1 < z_1 \rightarrow$ pole-zero doublet b) $z_1 < p_1 \rightarrow$ zero-pole doublet To sum up, embodiments as exemplified herein facilitate implementing (frequency compensated) arrangements, such as frequency compensated LDO arrangements providing a regulated output current Iout, with a transfer function which may comprise:

2 zeros and 1 pole (as exemplified in FIG. 3), 1 zero and 1 pole (as exemplified in FIG. 4 and FIG. 5).

One or more embodiments may exhibit a high degree of flexibility insofar as the positions of the zeros and the pole can be selected according to compensation specifications, for instance: one simple zero only, first the zero and then a zero-pole doublet, first the zero and then a pole-zero doublet, first the pole-zero doublet and then the zero.

In one or more embodiments, as exemplified herein, do not involve any appreciable extra power absorption with just a possible slight increase in terms of extra area.

A circuit as exemplified herein in connection with FIG. 3 may comprise:

a first transistor unit (for instance, M1) and a second transistor unit (for instance, M1')—possibly with M1 and M1' equal to a and (1-α) times M1 in FIG. 2)—having current paths therethrough coupled to an input current line configured to be traversed by an input current (for instance, Iin), the current paths through the first transistor unit and the second transistor unit referred to ground (for instance, GND) via respective first (degeneration) resistors (for instance, 2R1, possibly with resistive values equal to R1/α and R1/(1-α)), said first transistor unit in a diode arrangement with a control terminal thereof coupled to the current path therethrough at the side of the first transistor unit opposite the respective first resistor, a second transistor (for instance, M3) comprising a control terminal coupled to the control terminal of the first transistor unit and a current path through the second transistor coupled to an output current line configured to be traversed by an output current (for instance, Iout), the output current mirroring the input current via a current mirror factor (for instance, k), the current path through the second transistor (for instance, M3) referred to ground via a second resistor (for instance, R3), a first capacitor (for instance, C2) coupled to ground and to the control terminals of the first transistor unit and the second transistor unit with a coupling resistor (for instance, R2) arranged intermediate the first capacitor and the control terminal of the first transistor unit, and a second capacitor (for instance, C3) coupled to ground and to the current path through the second transistor at a node intermediate the second transistor and the second resistor.

In a circuit as exemplified herein in connection with FIG. 3, the first transistor unit and the second transistor unit may have a same width and a same length (for instance, as a result of α=0.5).

In a circuit as exemplified herein in connection with FIG. 3:

said respective first resistors (for instance, 2R1) may have respective resistance values twice a first resistance value (for instance, twice R1 as a result of α=0.5), the second resistor may have a second resistance value (for instance, R3) equal to the first resistance value (for instance, R1) divided by said current mirror factor (for instance, k).

A circuit as exemplified herein in connection with FIG. 4 or FIG. 5 may comprise:

a first transistor (for instance, M1) having a current path therethrough coupled to an input current line configured to be traversed by an input current (for instance, Iin), the current path through the first transistor referred to ground via a first resistor (for instance, R1), the first transistor in a diode arrangement with a control terminal of the first transistor coupled to the current path through the first transistor at the side of the first transistor opposite the first resistor, a second transistor (for instance, M3) comprising a control terminal coupled to the control terminal of the first transistor and a current path through the second transistor coupled to an output current line configured to be traversed by an output current (for instance, Iout), the output current mirroring the input current via a current mirror factor (for instance, k), the current path through the second transistor referred to ground via a second resistor (for instance, R3), a first capacitor (for instance, C1) coupled to ground and to the first transistor either at the control terminal of the first transistor or at the current path through the first transistor at a node intermediate the first transistor and the first resistor, a second capacitor (for instance, C3) coupled to ground and to the current path through the second transistor at a node intermediate the second transistor and the second resistor.

In a circuit as exemplified herein in connection with FIG. 4 or FIG. 5:

the first resistor may have a first resistance value (R1), the second resistor may have a second resistance value (R3) equal to the first resistance value divided by said current mirror factor (that is R1/k).

In a circuit as exemplified herein said current mirror factor may be an integer, optionally higher than one.

In a circuit as exemplified herein said transistors (for instance, M1, M3; M1, M1',M3) may comprise field-effect transistors including a gate terminal as said control terminal and a source-drain channel as said current flow path therethrough.

A device (for instance, 10) as exemplified herein may comprise:

a circuit as exemplified herein, and an output port (for instance, 100) coupled to said output current line and configured to provide a regulated signal at said output port.

A device as exemplified herein may comprise a Low Drop Out regulator.

Without prejudice to the underlying principles, the details and embodiments may vary, even significantly, with respect to what has been discussed by way of example only, without departing from the scope of protection.

The extent of protection is determined by the annexed claims.

The claims are an integral part of the disclosure of the embodiments as provided herein.

The invention claimed is:

1. A circuit, comprising:

a first transistor having a first current path therethrough referenced to ground by a first resistor;

a second transistor having a second current path therethrough referenced to ground by a second resistor;

wherein the first and second current paths are coupled to an input current line configured to be traversed by an input current;

wherein the first transistor is configured in a diode arrangement with a control terminal thereof coupled to the first current path;

a third transistor having a third current path therethrough referenced to ground by a third resistor;

wherein a control terminal of the third transistor is coupled to a control terminal of the first transistor;

wherein the third current path is coupled to an output current line configured to be traversed by an output current;

wherein the output current mirrors the input current via a current mirror factor;

a fourth resistor coupled between the control terminal of the first transistor and a control terminal of the second transistor;

a first capacitor coupled between ground and the control terminal of the second transistor; and a second capacitor coupled between ground and the third current path through the third transistor at a node which is intermediate the third transistor and the third resistor.

2. The circuit of claim 1, wherein the first transistor and the second transistor have a same width and a same length.

3. The circuit of claim 1, wherein:

the first and second resistors have a same resistance value which is two times a first resistance value, and the third resistor has a second resistance value equal to the first resistance value divided by said current mirror factor.

4. The circuit of claim 1, wherein said current mirror factor is an integer greater than one.

5. The circuit of claim 1, wherein said first, second and third transistors are each a field-effect transistor.

6. The circuit of claim 1, further comprising an output port coupled to said output current line and configured to provide a regulated signal of a device at said output port.

7. The circuit of claim 6, wherein the device is a Low Drop Out regulator.

8. A circuit, comprising:

a first transistor having a first current path therethrough referenced to ground by a first resistor;

a second transistor having a second current path therethrough referenced to ground by a second resistor;

wherein the first current path is coupled to an input current line configured to be traversed by an input current;

wherein the first transistor is configured in a diode arrangement with a control terminal thereof coupled to the first current path;

wherein a control terminal of the second transistor is coupled to a control terminal of the first transistor;

wherein the second current path is coupled to an output current line configured to be traversed by an output current;

wherein the output current mirrors the input current via a current mirror factor;

a first capacitor coupled between ground and the control terminals of the first and second transistors and second capacitor coupled between ground and the second current path through the second transistor at a node which is intermediate the second transistor and the second resistor.

9. The circuit of claim 8, wherein:

the first resistor has a first resistance value, and the second resistor has a second resistance value equal to a fraction of the first resistance value divided by said current mirror factor.

10. The circuit of claim 8, wherein said current mirror factor is an integer greater than one.

11. The circuit of claim 8, wherein said first and second transistors are each a field-effect transistor.

12. The circuit of claim 8, further comprising an output port coupled to said output current line and configured to provide a regulated signal of a device at said output port.

13. The circuit of claim 12, wherein the device is a Low Drop Out regulator.

* * * * *